US012582278B2

(12) United States Patent
Bian et al.

(10) Patent No.: US 12,582,278 B2
(45) Date of Patent: Mar. 24, 2026

(54) STRUCTURE FOR DETECTING ROTATION OF SPRAY ARMS OF HOUSEHOLD APPLIANCE AND HOUSEHOLD APPLIANCE

(71) Applicants: TE Connectivity Solutions GmbH, Schaffhausen (CH); Tyco Electronics (Shanghai) Co., Ltd., Shanghai (CN)

(72) Inventors: Weifeng Bian, Shanghai (CN); Yongyao Cai, Schaffhausen (CH); Shaoyong Wang, Shanghai (CN); Lei Pan, Shanghai (CN); Nicholas Langston, Schaffhausen (CH); Stephen Descioli, Schaffhausen (CH); Richard T. Shell, Schaffhausen (CH)

(73) Assignees: TE Connectivity Solutions GmbH, Schaffhausen (CH); Tyco Electronics (Shanghai) Co., Ltd., Shanghai (CN)

( * ) Notice: Subject to any disclaimer, the term of this patent is extended or adjusted under 35 U.S.C. 154(b) by 168 days.

(21) Appl. No.: 18/471,642

(22) Filed: Sep. 21, 2023

(65) Prior Publication Data

US 2024/0099542 A1 Mar. 28, 2024

(30) Foreign Application Priority Data

Sep. 22, 2022 (CN) ..... 202211160122.8

(51) Int. Cl.
*A47L 15/00* (2006.01)
*A47L 15/22* (2006.01)

(52) U.S. Cl.
CPC ..... *A47L 15/0049* (2013.01); *A47L 15/22* (2013.01); *A47L 2401/24* (2013.01)

(58) Field of Classification Search
None
See application file for complete search history.

(56) References Cited

U.S. PATENT DOCUMENTS

| | | | |
|---|---|---|---|
| 8,240,321 B2 | 8/2012 | Fountain et al. | |
| 10,194,782 B2 | 2/2019 | Pers et al. | |
| 2006/0278258 A1 | 12/2006 | Kara et al. | |
| 2021/0259510 A1* | 8/2021 | Durham | A47L 15/4221 |

FOREIGN PATENT DOCUMENTS

| | | |
|---|---|---|
| CN | 203290861 U | 11/2013 |
| CN | 109091093 A | 12/2018 |
| CN | 209463943 U | 10/2019 |
| CN | 107072461 B | 12/2019 |
| CN | 214856466 U | 11/2021 |
| DE | 102006012080 A1 | 9/2007 |
| EP | 3219243 B1 | 8/2021 |

* cited by examiner

*Primary Examiner* — Levon J Shahinian
(74) *Attorney, Agent, or Firm* — Barley Snyder

(57) ABSTRACT

A system adapted to detect rotation of at least two spray arms of a household appliance spaced along a longitudinal axis of the appliance includes a first detection magnet, a second detection magnet and a magnetic sensor. The first detection magnet is arranged on a first spray arm of the at least two spray arms. The second detection magnet is arranged on a second spray arm of the at least two spray arms. A magnetic field direction of the second detection magnet is different from a magnetic field direction of the first detection magnet. The magnetic sensor is arranged in the household appliance and is adapted to sense a motion status of the first detection magnet and the second detection magnet.

20 Claims, 4 Drawing Sheets

STRUCTURE FOR DETECTING ROTATION OF SPRAY ARMS OF HOUSEHOLD APPLIANCE AND HOUSEHOLD APPLIANCE

CROSS-REFERENCE TO RELATED APPLICATION

This application claims the priority benefit of Chinese Patent Application No. 202211160122.8 filed on Sep. 22, 2022, in the China National Intellectual Property Administration, the whole disclosure of which is incorporated herein by reference.

FIELD OF THE INVENTION

The present disclosure relates to household appliances, and more particularly, to a structure for detecting rotation of spray arms of a household appliance and a household appliance including the same.

BACKGROUND

A dishwasher, as a household appliance used for washing tableware, typically utilizes a rotating spray arm to expel washing water onto the tableware. A rotating speed of the spray arm varies with the degree of cleanness of tableware, the available water supply, and the presence or absence of obstructions. In this way, the rotating speed of spray arm is closely related to washing performance and efficiency.

When an existing dishwasher is in use, there is a risk of the spray arm being blocked, resulting in unclean washing or overcurrent of a motor driving the spray arm. Therefore, it is necessary to detect the working condition of the spray arm. An existing scheme for detecting the working condition of the spray arm is to embed a magnetic block on the spray arm, and install a reed switch on the inner wall of the dishwasher. In this way, the working condition of the spray arm can be determined by detecting the on-off state of the reed switch. This solution is inconvenient to install, and the detection provided thereby is not accurate enough to fully inspect all spray arms in the dishwasher.

SUMMARY

According to an embodiment of the present disclosure, a system adapted to detect rotation of at least two spray arms of a household appliance spaced along a longitudinal axis of the appliance includes a first detection magnet, a second detection magnet and a magnetic sensor. The first detection magnet is arranged on a first spray arm of the at least two spray arms. The second detection magnet is arranged on a second spray arm of the at least two spray arms. A magnetic field direction of the second detection magnet is different from a magnetic field direction of the first detection magnet. The magnetic sensor is arranged in the household appliance and is adapted to sense a motion status of the first detection magnet and the second detection magnet.

BRIEF DESCRIPTION OF THE DRAWINGS

The invention will now be described by way of example with reference to the accompanying Figures, of which.

DETAILED DESCRIPTION OF THE EMBODIMENTS

Figure 1:
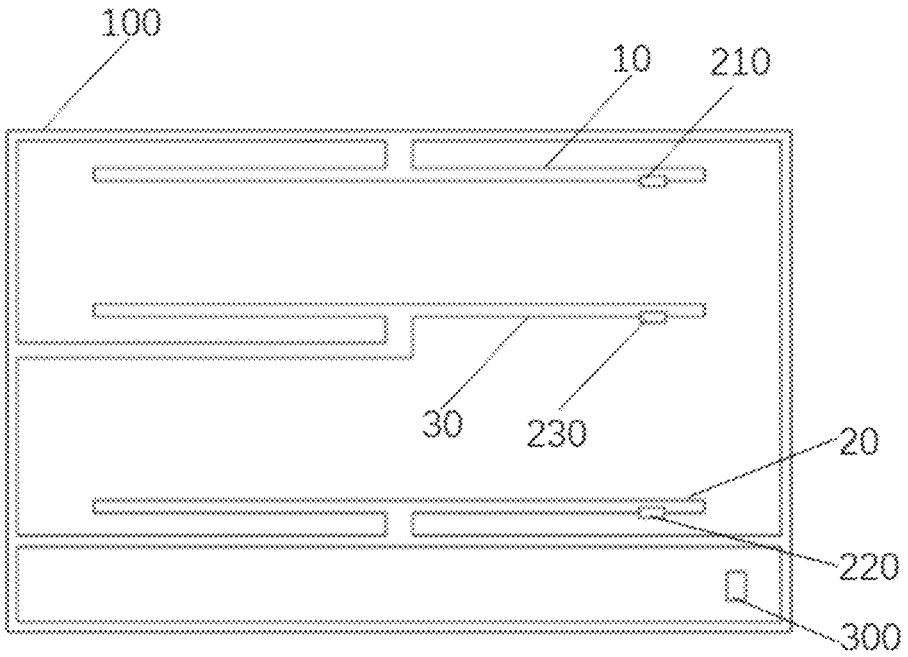
FIG. 1 is a perspective sectional view of a household appliance according to a first embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An improved system or structure for detecting rotation of spray arms of a household appliance is disclosed herein. The exemplary household appliance includes at least two spray arms spaced apart in the household appliance along a longitudinal axis. The structure includes a first detection magnet arranged on a first spray arm of the at least two spray arms, a second detection magnet arranged on a second spray arm of the at least two spray arms, and a magnetic sensor arranged in the household appliance. The magnetic sensor is adapted to sense a motion status of the first detection magnet and the second detection magnet. A magnetic field direction of the second detection magnet is different from a magnetic field direction of the first detection magnet.

Figure 3:
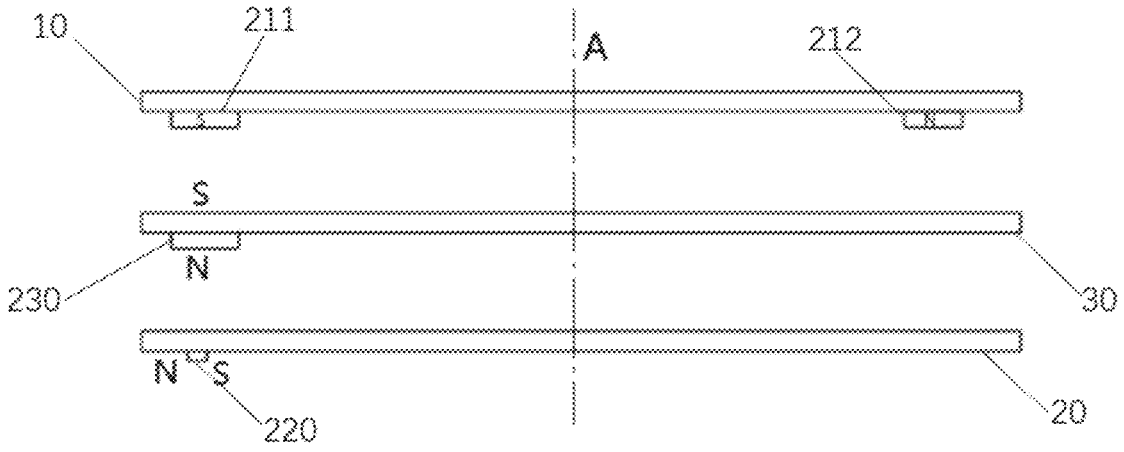
FIG. 3 is a schematic structural view of a structure for detecting rotation of spray arms of a household appliance according to an embodiment of the present disclosure.

FIG. 1 shows the overall structure of a disclosed household appliance according to a first embodiment of the present disclosure (for example, dishwasher). FIG. 3 is a schematic view of a structure for detecting rotation of spray arms of a household appliance according to the first embodiment. As shown in FIG. 1, the dishwasher includes a housing 100, a first spray arm 10, a second spray arm 20, a third spray arm 30, a first detection magnet 210 arranged on the first spray arm 10, a second detection magnet 220 arranged on the second spray arm 20, a third detection magnet 230 arranged on the third spray arm 30, and a magnetic sensor 300 arranged inside the housing 100. The three spray arms 10, 20, 30 are arranged inside the housing 100. In this embodiment, a three-axis AMR magnetic sensor can be used as the magnetic sensor 300.

In the exemplary embodiment, the first spray arm 10 is arranged at the top of the housing 100, the third spray arm 30 is arranged at the middle of the housing 100, the second spray arm 20 is arranged at the bottom of the housing 100, and the magnetic sensor 300 is arranged at the bottom of the housing 100. The magnetic field directions of the first detection magnet 210, the second detection magnet 220, and the third detection magnet 230 are different from each other, so that the magnetic sensor 300 can sense the motion status (for example, motion position, rotating speed, etc.) of each spray arm (for example, any one of the first spray arm 10, the second spray arm 20, and the third spray arm 30).

As shown in FIG. 3, in this embodiment, the first spray arm 10, the second spray arm 20, and the third spray arm 30 are spaced apart in the household appliance along a longitudinal axis A. The first detection magnet 210 includes a first magnetic block 211 and a second magnetic block 212. The first magnetic block 211 and the second magnetic block 212 are symmetrically arranged on the first spray arm 10 along the longitudinal axis A. The second detection magnet 220 may be a third magnetic block arranged on one side of the second spray arm 20. The third detection magnet 230 may be a fourth magnetic block arranged on one side of the third spray arm 30.

Figure 4:
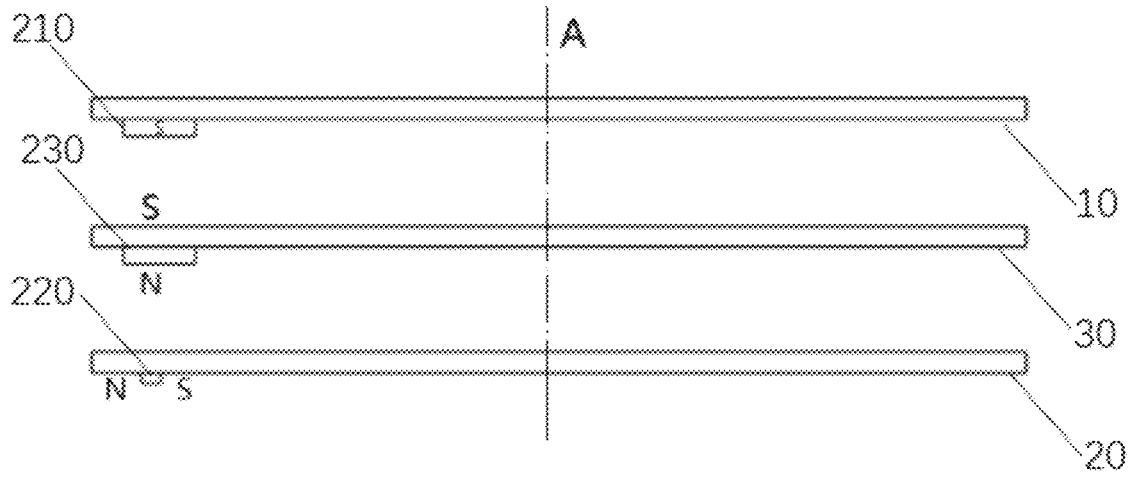
FIG. 4 is a schematic structural view of a structure for detecting rotation of spray arms of a household appliance according to another embodiment of the present disclosure.

In use, each detection magnet may be provided with magnetic blocks with different magnetic field intensity according to detection requirements, which is not limited herein. In this embodiment, the S pole of the first magnetic block 211 faces towards a first direction (for example, outwardly perpendicular to the paper surface). The N pole of the second magnetic block faces towards the first direction (for example, outwardly perpendicular to the paper surface). The N pole of the third magnetic block 220 faces towards an extension direction of the second spray arm 20. The N pole of the fourth magnetic block 230 faces towards a second direction. The second direction is perpendicular to the first direction and the extension direction above. As shown in FIG. 3, the second direction is downwardly perpendicular to the third spray arm 30. In addition, the arrangement of the multiple detection magnets in this embodiment may also be as shown in FIG. 4, and the description thereof is similar to that in the second embodiment, which will not be repeated here.

Referring to FIGS. 1 and 3, the second spray arm 20 is closest to the magnetic sensor 300, such that the size of the second detection magnet 220 is smaller than the size of the first detection magnet 210 and the size of the third detection magnet 230. When the first spray arm 10 or the third spray arm 30 is closest to the magnetic sensor 300, the size of the first detection magnet 210 or the size of the third detection magnet 230 is the smallest.

In view of the above, the magnetic field directions of the first detection magnet 210, the second detection magnet 220 and the third detection magnet 230 disclosed in the present embodiment are different from each other. In this way, the magnetic sensor 300 can sense the magnetic field intensity under the combined action of the three detection magnets. The specific principle is described herein.

Figure 5A:
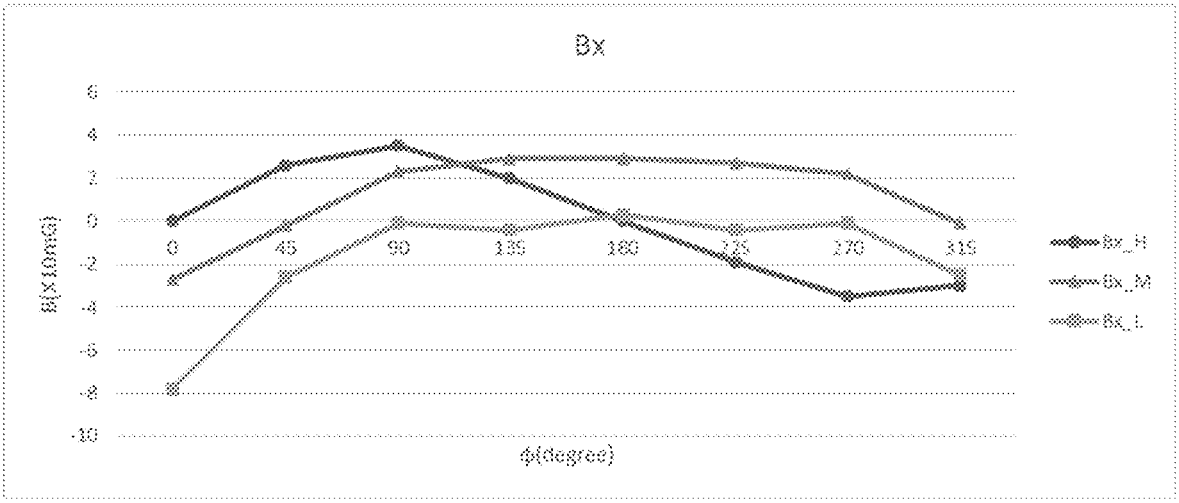
FIG. 5*a* is a schematic diagram of the magnetic field intensity detected by a magnetic sensor of the structure for detecting rotation of spray arms of a household appliance according to the present disclosure.
Figure 5B:
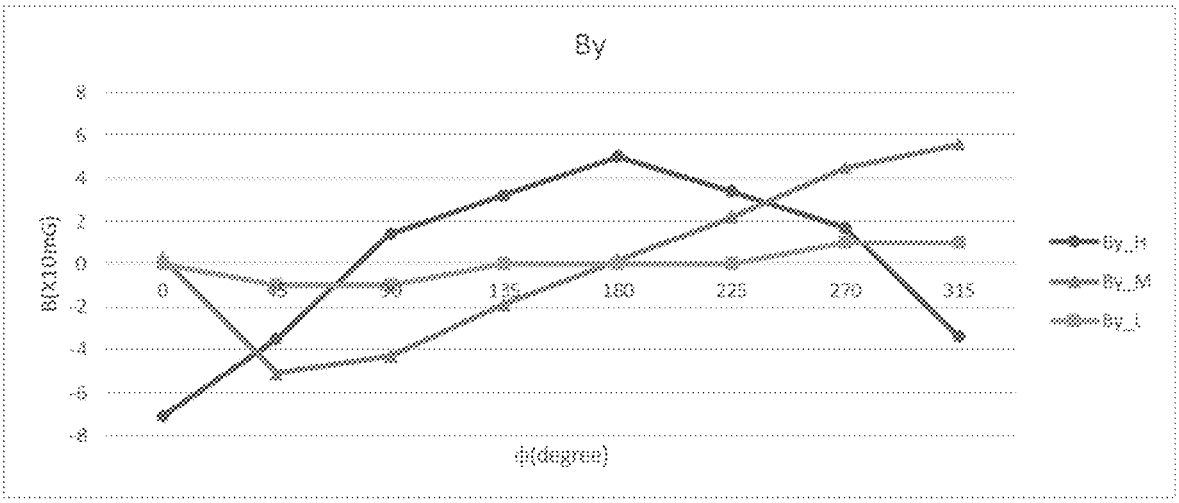
FIG. 5*b* is another schematic diagram of the magnetic field intensity detected by a magnetic sensor of the structure for detecting rotation of spray arms of a household appliance according to the present disclosure.
Figure 5C:
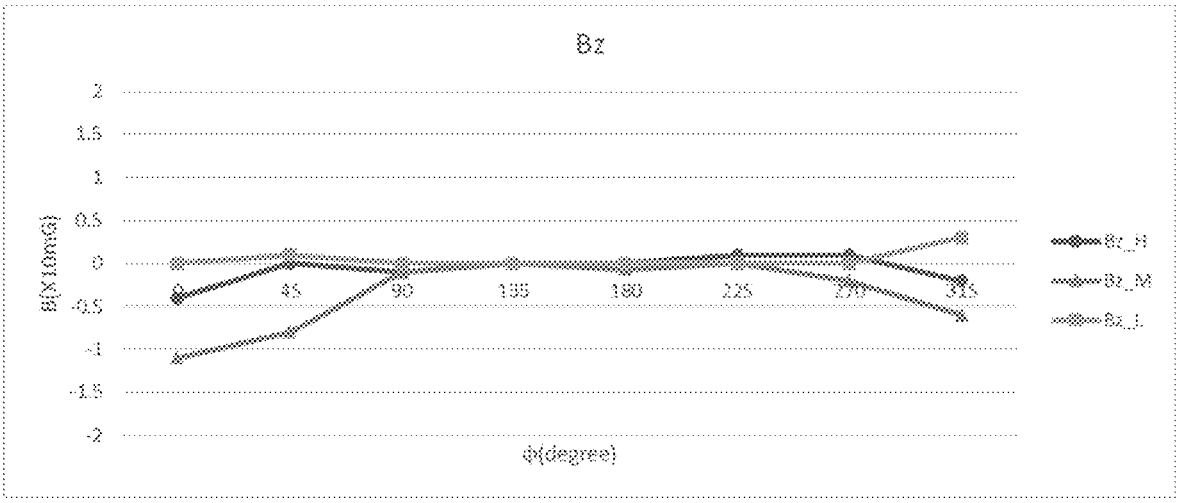
FIG. 5*c* is another schematic diagram of the magnetic field intensity detected by a magnetic sensor of the structure for detecting rotation of spray arms of a household appliance according to the present disclosure.

FIGS. 5*a*, 5*b* and 5*c*, respectively, show the variation curves of magnetic field intensity, as detected by the magnetic sensor 300 in the structure for detecting rotation of spray arms of a household appliance disclosed by this embodiment, of the spray arms with the rotation angle in different directions.

More specifically, FIG. 5*a* shows the relation between the magnetic field intensity of the three spray arms and the rotation angle in the first magnetic field direction (for example, x-direction). As illustrated, in the first magnetic field direction, the waveform of the magnetic field intensity of the first spray arm 10 varying on the rotation angle (corresponding to the curve "Bx_H") is approximately a sinusoidal wave, the waveform of the magnetic field intensity of the second spray arm 20 varying on the rotation angle (corresponding to the curve "Bx_L") is approximately a periodic triangular negative pulse, and the waveform of the magnetic field intensity of the third spray arm 30 varying on the rotation angle (corresponding to the curve "Bx_M") is approximately a periodic trapezoidal curve.

FIG. 5*b* shows the relation between the magnetic field intensity of the three spray arms and the rotation angle in the second magnetic field direction (for example, y-direction). As shown, in the second magnetic field direction, the waveforms of the magnetic field intensity of both the first spray arm 10 (corresponding to the curve "By_H") and the third spray arm 30 (corresponding to the curve "By_M") varying on the rotation angle are approximately sinusoidal waves, while the magnetic field intensity of the second spray arm 20 (corresponding to the curve "By_L") is approximately zero.

FIG. 5*c* shows the relation between the magnetic field intensity of the three spray arms and the rotation angle in the third magnetic field direction (for example, z-direction). In the third magnetic field direction, the waveform of the magnetic field intensity of the third spray arm 30 varying on the rotation angle (corresponding to the curve "Bz_M") is approximately a periodic triangular negative pulse, while the magnetic field intensity of both the first spray arm (corresponding to the curve "Bz_H") and the second spray arm (corresponding to the curve "Bz_L") is approximately zero.

In view of the above, first, data sensed by the magnetic sensor 300 in the detection time period, based on the relation between the magnetic field intensity and the rotational angle in the x, y, and z directions, as shown by the B_H curves in the FIGS. 5*a* to 5*c*, is obtained, in the case that the first detection magnet 210 is installed on the first spray arm 10 and no detection magnets are installed on the second spray arm 20 and the third spray arm 30. Then, data, sensed by the magnetic sensor 300 in the detection time period, based on the relation between the magnetic field intensity and the rotational angle in the x, y, and z directions, as shown by the B L curves in the FIGS. 5*a* to 5*c*, is obtained, in the case that the second detection magnet 220 is installed on the second spray arm 20 and no detection magnets are installed on the first spray arm 10 and the third spray arm 30. Then, data, sensed by the magnetic sensor 300 in the detection time period, based on the relation between the magnetic field intensity and the rotational angle in the x, y, and z directions, as shown by the B M curves in the FIGS. 5*a* to 5*c*, is obtained, in the case that the third detection magnet 230 is installed on the third spray arm 30 and no detection magnets are installed on the first spray arm 10 and the second spray arm 20.

Next, after the corresponding detection magnets are installed on the three spray arms respectively, the following operation steps are performed during the operation of the dishwasher for detection. Step 1: detecting, by the magnetic sensor 300, the magnetic field intensity in the z-direction. If the absolute value of the peak value of the detected data is greater than a first threshold (for example, 10 mG or other data), it can be determined that the third spray arm 30 rotates normally, and the rotating speed and position of the third spray arm can be calculated according to the period of occurrence of the peak value. Step 2: if it has been determined in step 1 that the third spray arm 30 rotates normally, detecting, by the magnetic sensor 300, the magnetic field intensity in the y-direction, and performing the following algorithm processing on the detected data: subtracting in real time the magnetic field intensity (as shown by By_M in FIG. 5*b*) in the y-direction separately generated by the third spray arm 30 at the corresponding position according to the rotation position of the third spray arm obtained in step 1. If the processed data has a periodic peak value and the absolute value of the peak value is greater than a second threshold (for example, 70 mG or other data), it can be determined that the first spray arm 10 rotates normally, and the rotating speed and real-time position of the first spray arm 10 can be calculated in combination with the magnetic field intensity (as shown by By_H in FIG. 5*b*) in the y-direction separately generated by the first spray arm 10. Step 3: if it has been determined in steps 1 and 2 that the third spray arm 30 and the first spray arm 10 rotate normally, detecting, by the magnetic sensor 300, the magnetic field intensity in the x-direction, and performing the following algorithm processing on the detected data: subtracting the magnetic field intensity (as shown by Bx_M in FIG. 5*a*) in the x-direction separately generated by the third spray arm 30 at the corresponding position and subtracting the magnetic field intensity (as shown by Bx_H in FIG. 5*a*) in the x-direction separately generated by the first spray arm 10 at the corresponding position according to the real-time rotation position of the third spray arm 30 obtained in step 1 and the real-time rotation position of the first spray arm 10 obtained in step 2. If the processed data has a periodic peak value and the absolute value of the peak value is greater than a third threshold (for example, 70 mG or other data), it can be determined that the second spray arm 20 rotates normally, and the rotating speed and position of the second spray arm can be calculated in combination with the magnetic field intensity (as shown by Bx_L in FIG. 5*a*) in the x-direction separately generated by the second spray arm 20.

Based on the above calculation method, the working parameters such as the motion position and rotating speed of each spray arm at different moments can be obtained by sensing of the detection magnets through the magnetic sensor 300.

Compared with the existing detection system, the structure or system for detecting rotation of spray arms of a household appliance disclosed herein can accurately detect the working state of multiple spray arms by means of the arrangement of a magnetic sensor, and at the same time reduce the manufacturing cost and simplify the installation.

Figure 2:
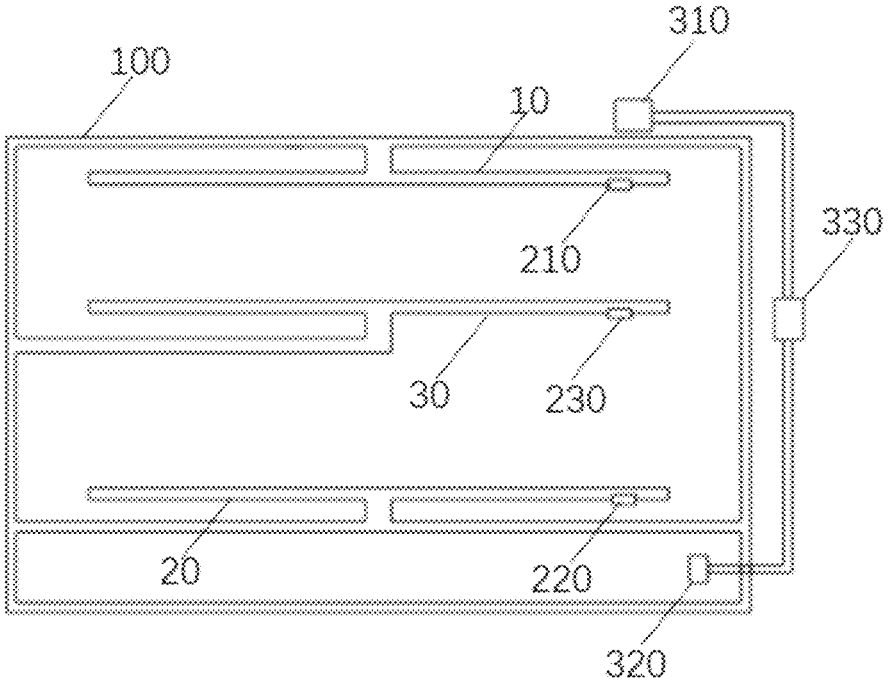
FIG. 2 is a perspective sectional view of a household appliance according to a second embodiment of the present disclosure.

FIG. 2 shows the overall structure of the disclosed household appliance (for example, dishwasher) in accordance with a second embodiment of the present disclosure. FIG. 4 is a schematic structural view of a structure for detecting rotation of spray arms of a household appliance according to the second embodiment.

As shown in FIG. 2, the dishwasher includes a housing 100, a first spray arm 10, a second spray arm 20, a third spray arm 30, a first detection magnet 210 arranged on the first spray arm 10, a second detection magnet 220 arranged on the second spray arm 20, a third detection magnet 230 arranged on the third spray arm 30, a first magnetic sensor 310, a second magnetic sensor 320, and a third magnetic sensor 330. The three spray arms are arranged inside the housing 100. The three magnetic sensors are arranged inside the housing 100.

In this embodiment, the first spray arm 10 is arranged at the top of the housing 100, the third spray arm 30 is arranged at the middle of the housing 100, and the second spray arm 20 is arranged at the bottom of the housing 100. In addition, the first magnetic sensor 310 is arranged at the top of the housing 100 to detect motion status of the first spray arm 10. The second magnetic sensor 320 is arranged at the bottom of the housing 100 to detect motion status of the second spray arm 20. The third magnetic sensor 330 is arranged at the middle of the housing 100 to detect motion status of the third spray arm 30.

The magnetic field directions of the first detection magnet 210, the second detection magnet 220, and the third detection magnet 230 are different from each other, such that multiple magnetic sensors can respectively sense the motion status (for example, motion position, rotating speed, etc.) of the corresponding spray arms. Furthermore, in this example, the first magnetic sensor 310, the second magnetic sensor 320, and the third magnetic sensor 330 are all three-axis AMR magnetic sensors. In actual design, other types of magnetic sensors can be selected according to requirements.

As shown in FIG. 4, in this embodiment, the first spray arm 10, the second spray arm 20, and the third spray arm 30 are spaced apart in the household appliance along a longitudinal axis A. Specifically, the first detection magnet 210 includes a first magnetic block, wherein the first magnetic block is arranged on one side of the first spray arm 10 and the S pole thereof faces towards a first direction (for example, outwardly perpendicular to the paper surface). The second detection magnet 220 may be a third magnetic block arranged on one side of the second spray arm 20, wherein the N pole of the third magnetic block faces towards an extension direction of the second spray arm 20. The third detection magnet 230 may be a fourth magnetic block arranged on one side of the third spray arm 30. The N pole of the fourth magnetic block faces towards a second direction, wherein the second direction is perpendicular to the first direction and the extension direction above. As shown in FIG. 4, the second direction is downwardly perpendicular to the third spray arm 30. In actual design, magnetic blocks with different magnetic field intensity can be selected according to requirements and assembled into the corresponding detection magnet.

In view of the above, the magnetic field directions of the first detection magnet 210, the second detection magnet 220 and the third detection magnet 230 disclosed in the present embodiment are different from each other, such that the first magnetic sensor 310 can sense the magnetic field status of the first detection magnet 210, the second magnetic sensor 320 can sense the magnetic field status of the second detection magnet 220, and the third magnetic sensor 330 can sense the magnetic field status of the third detection magnet 230. In addition, the arrangement of the multiple detection magnets in this embodiment may also be as shown in FIG. 3, and the description thereof is similar to that in the first embodiment, which will not be repeated here.

In the present embodiment, each magnetic sensor respectively senses the motion status (for example, motion position, rotating speed, etc.) of the corresponding detection magnet, so as to achieve correct detection of each spray arm. In the structure for detecting rotation of spray arms of a household appliance disclosed in this embodiment, placement positions of magnetic poles of detection magnets are different, and therefore, regularly varying magnetic fields in different directions are generated at the corresponding installation positions of the magnetic sensors, so that the rotation state of each spray arm can be distinguished.

A household appliance (for example, a dishwasher) is disclosed in a third embodiment, which includes a first spray arm 10 and a second spray arm 20, as shown in FIG. 1 or FIG. 2. In this embodiment, the structure for detecting rotation of spray arms of a household appliance correspondingly includes a first detection magnet 210, a second detection magnet 220 and a magnetic sensor 300. Specifically, the first detection magnet 210 is arranged on the first spray arm 10, the second detection magnet 220 is arranged on the second spray arm 20, and the magnetic field directions of the first detection magnet 210 and the second detection magnet 220 are different from each other. The specific installation positions of the first detection magnet 210 and the second detection magnet 220 may be similar to those in FIG. 3 or FIG. 4.

In the instant embodiment, as the magnetic field directions of the first detection magnet 210 and the second detection magnet 220 are different from each other, the magnetic sensor 300 respectively senses the magnetic fields that vary regularly in different directions, and the rotation status of the first spray arm 10 and the second spray arm 20 are distinguished by means of the algorithm processing similar to that in the first embodiment.

A household appliance (for example, a dishwasher) is also disclosed in a fourth embodiment, which includes a first spray arm 10 and a second spray arm 20, as shown in FIG. 1 or FIG. 2. In this embodiment, the structure for detecting rotation of spray arms of a household appliance correspondingly includes a first detection magnet 210, a second detection magnet 220, a first magnetic sensor 310, and a second magnetic sensor 320. Specifically, the first detection magnet 210 is arranged on the first spray arm 10, the second detection magnet 220 is arranged on the second spray arm 20, and the magnetic field directions of the first detection magnet 210 and the second detection magnet 220 are different from each other. The specific installation positions of the first detection magnet 210 and the second detection magnet 220 may be similar to those in FIG. 3 or FIG. 4.

In this embodiment, the installation positions of the first magnetic sensor 310 and the second magnetic sensor 320 are similar to those in FIG. 2, so that the first magnetic sensor 310 can sense the motion status of the first detection magnet 210, and the second magnetic sensor 320 can sense the motion status of the second detection magnet 220. As the magnetic field directions of the first detection magnet 210 and the second detection magnet 220 are different from each other, the first magnetic sensor 310 and the second magnetic sensor 320 sense the magnetic field intensity of the first detection magnet 210 and the second detection magnet 220 respectively, so that the rotation status of the first spray arm 10 and the second spray arm 20 can be accurately detected.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A system adapted to detect rotation of at least two spray arms of a household appliance spaced along a longitudinal axis of the appliance, comprising:

a first detection magnet arranged on a first spray arm of the at least two spray arms;

a second detection magnet arranged on a second spray arm of the at least two spray arms, a magnetic field direction of the second detection magnet is different from a magnetic field direction of the first detection magnet; and a magnetic sensor arranged in the household appliance and adapted to sense a motion status of the first detection magnet and the second detection magnet.

2. The system according to claim 1, wherein the motion status includes motion position and rotating speed of each of the first detection magnet and the second detection magnet.

3. The system according to claim 1, wherein the household appliance further includes a third spray arm spaced apart from the at least two spray arms along the longitudinal axis, and the system further comprises a third detection magnet arranged on the third spray arm, a magnetic field direction of the third detection magnet being different from the magnetic field direction of the first detection magnet and the magnetic field direction of the second detection magnet, the magnetic sensor adapted to sense a motion status of the third detection magnet.

4. The system according to claim 3, wherein the first detection magnet comprises a first magnetic block and a second magnetic block symmetrically arranged on two sides of the first spray arm, an S pole of the first magnetic block facing towards a first direction and an N pole of the second magnetic block facing towards the first direction.

5. The system according to claim 4, wherein the second detection magnet comprises at least one third magnetic block, the third magnetic block arranged on one side of the second spray arm and an N pole of the third magnetic block facing towards an extension direction of the second spray arm.

6. The system according to claim 5, wherein the third detection magnet comprises at least one fourth magnetic block, the fourth magnetic block arranged on one side of the third spray arm and an N pole of the fourth magnetic block facing towards a second direction, wherein the second direction is perpendicular to the first direction and perpendicular to the extension direction of the second spray arm.

7. The system according to claim 3, wherein:

the first detection magnet comprises a first magnetic block, the first magnetic block arranged on one side of the first spray arm and an S pole of the first magnetic block facing towards a first direction;

the second detection magnet comprises at least one third magnetic block, the third magnetic block arranged on one side of the second spray arm and an N pole of the third magnetic block facing towards an extension direction of the second spray arm; and the third detection magnet comprises at least one fourth magnetic block, an N pole of the fourth magnetic block facing towards a second direction, wherein the second direction is perpendicular to the first direction and perpendicular to the extension direction of the second spray arm.

8. The system according to claim 3, wherein a size of the first detection magnet is smaller than a size of the second detection magnet and a size of the third detection magnet when the first detection magnet is closest to the magnetic sensor.

9. The system according to claim 3, wherein a size of the second detection magnet is smaller than a size of the first detection magnet and a size of the third detection magnet when the second detection magnet is closest to the magnetic sensor.

10. The system according to claim 3, wherein a size of the third detection magnet is smaller thana size of the first detection magnet and a size of the second detection magnet when the third detection magnet is closest to the magnetic sensor.

11. The household appliance according to claim 10, wherein the household appliance is a dishwasher.

12. A system for detecting rotation of spray arms of a household appliance including at least two spray arms spaced apart in the household appliance along a longitudinal axis, comprising:

a first detection magnet arranged on a first spray arm of the at least two spray arms;

a second detection magnet arranged on a second spray arm of the at least two spray arms, a magnetic field direction of the second detection magnet being different from a magnetic field direction of the first detection magnet;

a first magnetic sensor arranged in a first position inside the household appliance and adapted to sense a motion status of the first detection magnet; and a second magnetic sensor, arranged in a second position inside the household appliance and adapted to sense a motion status of the second detection magnet.

13. The system according to claim 12, wherein the motion status includes motion position and rotating speed of each of the first detection magnet and the second detection magnet.

14. The system according to claim 12, wherein the household appliance further comprises a third spray arm, and the system further includes:

a third detection magnet arranged on the third spray arm, a magnetic field direction of the third detection magnet being different from the magnetic field direction of the second detection magnet and the magnetic field direction of the first detection magnet; and a third magnetic sensor arranged in a third position inside the household appliance for sensing motion status of the third detection magnet.

15. The system according to claim 14, wherein the first detection magnet comprises a first magnetic block and a second magnetic block which are symmetrically arranged on two sides of the first spray arm, an S pole of the first magnetic block facing towards a first direction, an N pole of the second magnetic block facing towards the first direction.

16. The system according to claim 15, wherein the second detection magnet comprises at least one third magnetic block arranged on one side of the second spray arm and an N pole of the third magnetic block facing towards an extension direction of the second spray arm.

17. The system according to claim 16, wherein the third detection magnet comprises at least one fourth magnetic block arranged on one side of the third spray arm and an N pole of the fourth magnetic block facing towards a second direction, wherein the second direction is perpendicular to the first direction and perpendicular to the extension direction of the second spray arm.

18. The system according to claim 14, wherein:

the first detection magnet comprises a first magnetic block arranged on one side of the first spray arm and an S pole of the first magnetic block facing towards a first direction; and the second detection magnet comprising at least one third magnetic block arranged on one side of the second spray arm and an N pole of the third magnetic block facing towards an extension direction of the second spray arm.

19. The system according to claim 18, wherein:

the third detection magnet comprises at least one fourth magnetic block, an N pole of the fourth magnetic block facing towards a second direction; and the second direction is perpendicular to the first direction and perpendicular to the extension direction of the second spray arm.

20. A household appliance, comprising:

two or more spray arms spaced apart in the household appliance along a longitudinal axis; and a system detecting a rotation of the two or more spray arms, comprising:

a first detection magnet arranged on a first spray arm of the two or more spray arms;

a second detection magnet arranged on a second spray arm of the two or more spray arms, a magnetic field direction of the second detection magnet is different from a magnetic field direction of the first detection magnet; and a magnetic sensor arranged in the household appliance and sensing a motion status of the first detection magnet and the second detection magnet.

* * * * *